US008863851B2

(12) United States Patent
Davis et al.

(10) Patent No.: US 8,863,851 B2
(45) Date of Patent: Oct. 21, 2014

(54) MILLED PACKER RETAINING TOOL WITH REVERSE CIRCULATION

(75) Inventors: John P. Davis, Cypress, TX (US); Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 670 days.

(21) Appl. No.: 12/355,563

(22) Filed: Jan. 16, 2009

(65) Prior Publication Data

US 2010/0181789 A1 Jul. 22, 2010

(51) Int. Cl.
*E21B 31/16* (2006.01)

(52) U.S. Cl.
CPC ..... *E21B 31/16* (2013.01)
USPC ..... 166/377; 166/55; 166/55.2; 166/55.7; 166/297; 166/98; 166/99; 294/86.4; 294/86.1

(58) Field of Classification Search
CPC ..... E21B 29/002; E21B 29/00; E21B 31/16
USPC ..... 166/377, 55, 55.2, 55.3, 55.7, 297, 98, 166/99; 294/86.1, 86.12, 86.14, 86.15, 294/86.19, 86.22
See application file for complete search history.

(56) References Cited

U.S. PATENT DOCUMENTS

| | | | | |
|---|---|---|---|---|
| 2,915,127 | A * | 12/1959 | O'Farrel | 166/99 |
| 3,150,718 | A * | 9/1964 | Crowe | 294/86.17 |
| 3,382,925 | A * | 5/1968 | Jennings | 166/99 |
| 3,735,827 | A | 5/1973 | Berryman | |
| 3,797,591 | A | 3/1974 | Berryman | |
| 4,059,167 | A | 11/1977 | Berryman | |
| 5,123,489 | A * | 6/1992 | Davis et al. | 166/377 |
| 5,176,208 | A * | 1/1993 | Lalande et al. | 166/99 |
| 5,402,850 | A * | 4/1995 | Lalande et al. | 166/301 |
| 5,580,114 | A | 12/1996 | Palmer | |
| 6,681,858 | B2 * | 1/2004 | Streater | 166/301 |
| 6,848,506 | B1 * | 2/2005 | Sharp et al. | 166/301 |
| 2002/0053428 | A1 * | 5/2002 | Maples | 166/99 |

OTHER PUBLICATIONS

Baker Oil Tools, Conventional Fishing Technical Unit, Washover Drill Collar Spear Brochure, Oct. 2003, p. 20.
Baker Oil Tools, Conventional Fishing Technical Unit, "CK" Packer Milling Tool Brochure, Oct. 2003, p. 6.
Van Steveninck, Eric, et al., "An Innovative High Strength Drill Pipe Mechanical Cutting Solution Using Coiled Tubing", SPE 81742, Apr. 2003, 1-9.

(Continued)

*Primary Examiner* — James Sayre
(74) *Attorney, Agent, or Firm* — Steve Rosenblatt

(57) ABSTRACT

A grapple device is secured to a mill to allow relative rotation between them. The grapple has an outward bias to allow it to grip the packer bore or an extension from the packer. The mandrel has a wedge adjacent its lower end and torque fingers that fit between grapple segments when relative longitudinal movement occurs between the mandrel and the grapple assembly. The grapple assembly has a left hand thread so that it comes out of the packer if the mandrel engages the grapple assembly in a manner for tandem rotation. The torque fingers on the wedge on the mandrel support the grapple fingers over their length as rotation to the right removes the grapple assembly from the packer bore. Reverse circulation takes away the cuttings into the mill bore where they are separated from the reverse circulating fluid.

23 Claims, 2 Drawing Sheets

(56) References Cited

OTHER PUBLICATIONS

Huval, Sidney, et al., "Real-Time Data Enables Real-Time Decision Making in Well Intervention", SPE 116740, Sep. 2008, 1-6.

McNicol, Jim, et al., "Smart Tool System Boosts Performance of Intervention Operations", SPE 105242, Mar. 2007, 1-6.

McNicol, J., et al., "New Closed-Loop Control System Reduces Risk in Intervention Operations", SPE 102658, Sep. 2006, 1-8.

* cited by examiner

MILLED PACKER RETAINING TOOL WITH REVERSE CIRCULATION

FIELD OF THE INVENTION

The field of the invention is a retainer for a downhole packer that is milled out so that the packer can be retrieved once sufficiently milled.

BACKGROUND OF THE INVENTION

There are occasions where packers or other tools need to be milled out and yet portions of the tool need to be retained from falling in the hole once enough milling has gone on to release the packer or other tool. In the past such tools have been advanced into the packer bore or an extension to such a packer bore and included a grapple that was forced into the bore. If the packer let go the grapple was cammed outwardly by a series of inclined surfaces with such camming being triggered by the released weight of the remaining packer. The mandrel could be picked up and turned to the right to engage ratchet teeth so that a left hand thread is engaged to allow rotation of the grapple gripping member with respect to the packer bore for a release, if necessary. One such prior design is shown in Streater U.S. Pat. No. 6,681,858.

Streater uses a longitudinally split cylindrically shaped grapple member 106 that rides in a wedge 104. Grapple 106 has a groove 126 through which extends a tab 110. The groove and the tab are in the middle of the cylinder shape with the tab not extending as far out of the groove so that it stays clear of the packer bore. The problem with this design is during an attempt to release the packer by engaging teeth 124 and 134 while rotating to the right. As the grapple 106 which has an exterior left hand thread starts to come out of the packer bore while having torque transmitted into it through tab 110, some of the grapple 106 is still in the packer bore while the tab 110 transmits torque through slot 126 to the remainder of the cylindrically shaped grapple member now free of the packer bore and less resistant to applied torque. What can happen is that a shear failure can occur at the grapple which, in turn, results in getting the whole tool stuck with the part milled out packer.

The CK Packer Milling Tool sold by Baker Oil Tools is a peripheral mill that supports an internal wash pipe that has a grapple at the end. The mill is circulated through the wash pipe and the existing flow picks up cuttings for the return trip to the surface in the annulus. The small clearance between the mill housing and the wash pipe will not allow reverse circulation with cuttings into the mill housing to work nor can this design be simply modified to create a flow passage big enough between the wash pipe and the mill housing to accommodate the mill debris. The Washover Drill Collar Spear also sold by Baker Oil Tools uses gravity to grip the released drill collars by combining slips at the ends of collet fingers driven out by a taper on a mandrel that falls with the drill collars. The slips grab a wash over pipe extending around the slips.

The present invention provides a grapple for a downhole tool being milled out where the grapple members are better supported in a removal attempt when turning to the right. In a preferred embodiment fingers with exterior wickers that form a left hand thread extend from a ring. The wedge assembly has a series of torque fingers that preferably span the length of the grapple wickers and preferable are disposed on opposed sides of the grapple fingers. The ramp adds force to rotate the grapple when it is turned to the right. A reverse circulation pattern is used with the mill to remove and capture cuttings through the mill body in conjunction with the grapple device.

These and other features of the present invention will be more readily understood by those skilled in the art from a review of the description of the preferred embodiment and the associated drawings that appear below while recognizing that the appended claims are the full measure of the invention.

SUMMARY OF THE INVENTION

A grapple device is secured to a mill to allow relative rotation between them. The grapple has an outward bias to allow it to grip the packer bore or an extension from the packer. The mandrel has a wedge adjacent its lower end and torque fingers that fit between grapple segments when relative longitudinal movement occurs between the mandrel and the grapple assembly. The grapple assembly has a left hand thread so that it comes out of the packer if the mandrel engages the grapple assembly in a manner for tandem rotation. The torque fingers on the wedge on the mandrel support the grapple fingers over their length as rotation to the right removes the grapple assembly from the packer bore. Reverse circulation takes away the cuttings into the mill bore where they are separated from the reverse circulating fluid.

DETAILED DESCRIPTION OF THE PREFERRED EMBODIMENT

Figure 1:
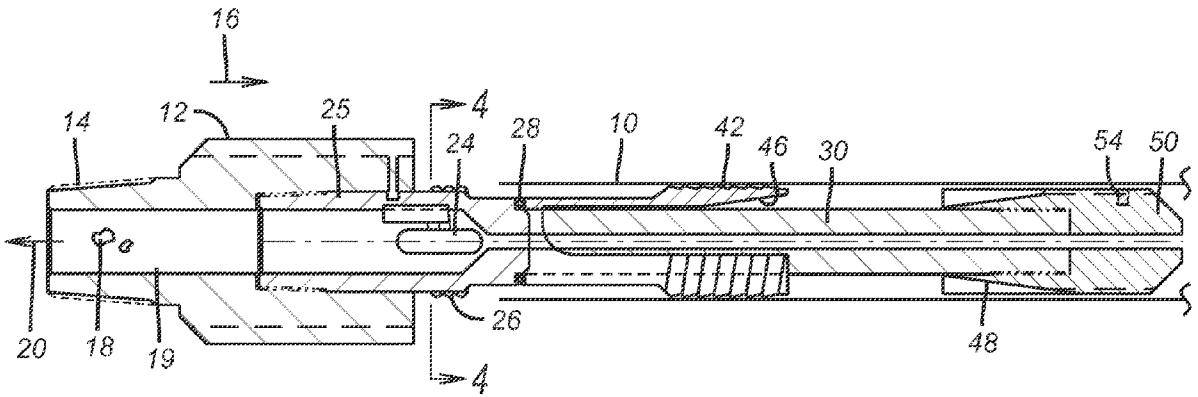
FIG. 1 shows the tool in the position that it assumes when inserted into the packer bore for milling.
Figure 4:
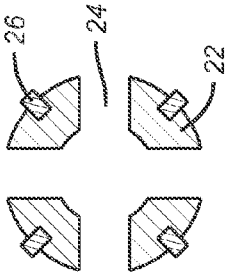
FIG. 4 is a view along line 4-4 of FIG.
Figure 3:
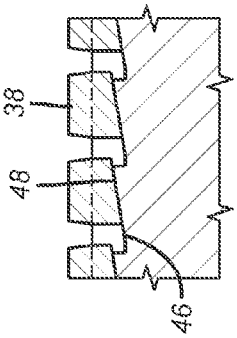
FIG. 3 is a section along lines 3-3 of FIG. 2.
Figure 5:
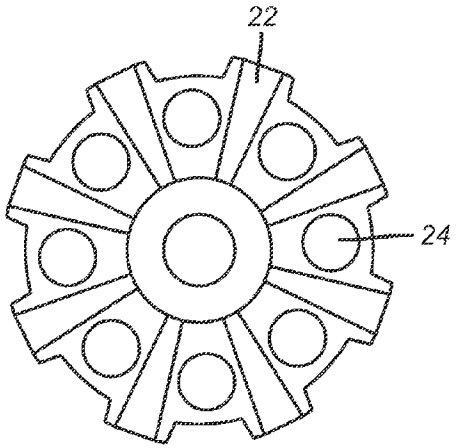
FIG. 5 is a bottom view showing the reverse flow entry ports between the mill blades.
Figure 6:
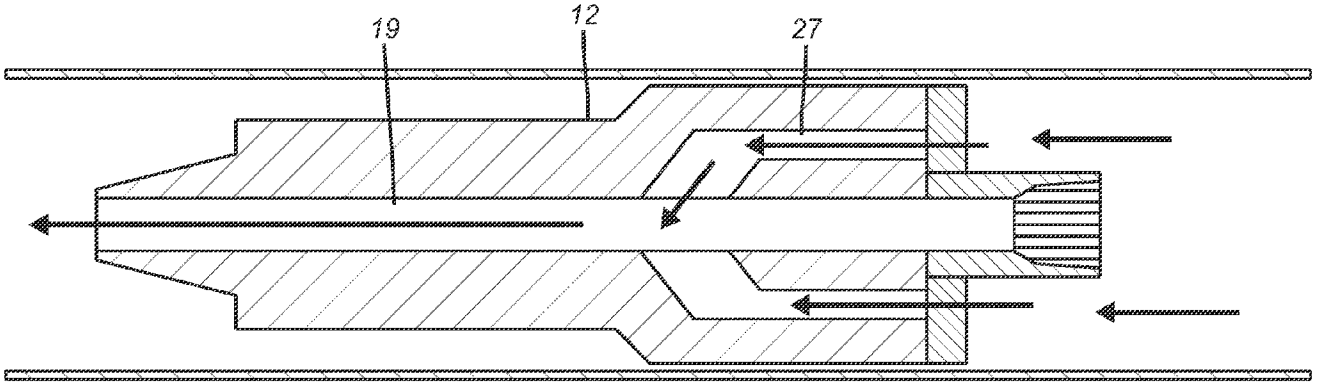
FIG. 6 is a section view of the mill shown in bottom view in FIG. 5

FIG. 1 shows a packer bore or extension 10 with a mill 12 landed on it. A string (not shown) is connected at threads 14. Arrow 16 represents reverse circulation from the surface that takes cuttings 18 back to the surface through passage 19 as indicated with arrow 20. The mill 12 has four blades 22 shown in FIG. 4. Openings 24 are disposed on a nipple 25, which is in flow communication with passage 19 and are preferably oblong with rounded ends as shown in FIG. 1. Mill blades 22 have hardened inserts 26 to aid in milling up the packer bore or extension 10. Passage 19 leads to an adjacent cuttings separator (not shown) so that the cuttings 18 are trapped shortly after they are formed while the reverse circulating fluid continues to the surface in passage 19. Alternatively, as shown in FIGS. 5 and 6, the openings 24 can be located between blades 22 and right in the body of the mill 12. A series of passages 27 lead into the central passage 19, as previously described.

Figure 2:
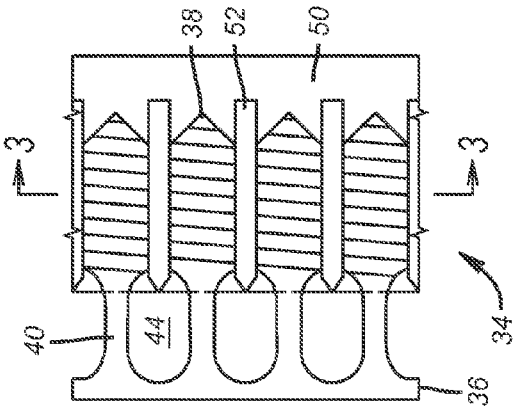
FIG. 2 is a rolled out view of the grapple assembly.

A mandrel 30 is connected to the mill 12 so that the mandrel is rotating as the mill 12 turns. A grapple assembly 34 shown rolled flat in FIG. 2 is loosely mounted over the mandrel 30 and connected to the mill 12 with a bearing 28. It has a top ring 36 with a series of fingers 38 attached by thin connectors 40. A gripping surface 42 on each finger 38 has external wickers. When wrapped around the gripping surface or wickers define a left hand thread so that when urged to the right it will be turned out of the packer bore or extension 10 for a release.

The fingers 38 are biased radially outwardly due to connectors 40 and the openings 44 between them. The bottoms 46 of fingers 38 are not only tapered as shown in FIG. 1 but they are also inclined to take advantage of the mandrel being rotated to the right to get additional leverage when forced to turn by inclined surfaces 48 on bottom sub 50. In essence the plane of slopes 46 and 48 is skewed with respect to a tangent line to a circle about the axis of the mandrel 30 illustrated in the section of FIG. 4. Bottom sub 50 has fingers 52 that are longer than the fingers 38 such that when the bottom sub 50 and its ramps 48 engage the tapered surfaces 46 on fingers 38 there is a pair of fingers 52 that straddle each finger 38 as the mandrel 30 and the grapple assembly 34 turn in tandem to back out left hand thread surface 42 from the packer bore or extension 10.

A shear pin 54 extends from bottom sub 50 to provide a surface signal that the packer bore or extension 10 has been found. A set down weight on mill 12 then breaks the shear pin 54 and the mandrel 30 and the bottom sub 50 continue a descent into the packer bore 10. Eventually the ring 36 is pushed against bearing 28 when the wickers 42 on fingers 38 get pushed into the bore 10 by continuing downward movement of the mill 12. When the blades 22 land on the bore 10 the downward descent is complete and the rotation of the mill 12 can start. At that time, the fingers 38 grip the inside of the bore 10 while mandrel 30 rotates with mill 12. There is a gap between mandrel 30 and ring 36 so that the packer bore is merely gripped by fingers 38 but is not supported until the packer itself is milled loose. Bearing 28 allows the mill 12 to turn while the mandrel 30 and the fingers 38 do not turn. There are two possible scenarios. The packer can break loose and start to fall or the milling can stop and the mill 12 can be raised to bring the bottom sub 50 under the fingers 38. Either way there is no relative rotation between the bottom sub 50 and the fingers 38. If the packer breaks loose, the fingers 38 that grip the bore 10 with wickers 42 allow the grapple assembly 34 to slide down mandrel 30 until the taper 48 gets under taper 46 so that the packer can be simply removed. On the other hand, if the milling is stopped and the mill is no longer turning, it is safe to pick up on it to move tapers 48 up to tapers 46 and fingers 52 into position to straddle fingers 38. At that point turning to the right will rotate the grapple assembly 34 while its fingers 38 are supported against being sheared by adjacent torque fingers 52. Since wickers 42 are a left hand thread, turning to the right should remove the fingers 38 from contact with the bore 10 so that the tool can be removed, if needed.

Those skilled in the art will appreciate that the fingers 52 continue to provide torsional support to the fingers 38 as long as any part of them still engage the bore 10. Additionally, the reverse circulation mill 12 when combined with the grapple assembly 34 allows efficient capture of cuttings in a cuttings separator located near the mill 12 where the fluid velocities with cuttings are still high. The grapple structure is more flexible for getting a grip and yet stronger when being forced out of the bore 10 with right hand rotation. The number of blades and access ports for cuttings can be varied. The shape and number of torque fingers 52 can be varied and other forms of torsional support is envisioned that continues to be effective as long as wickers 42 are in the bore 10. The shear pin 54 can also be some other form of surface signal that the bottom sub 50 has landed on the bore or extension 10. The sloping contact of surfaces 46 and 48 enhance the extraction force to the left hand thread made by wickers 42 when there is rotation to the right to release from the packer. Although a packer is the preferred application other tools with a top bore for grapple insertion can also be milled and recovered when they release from the surrounding tubular.

In some situations it may be advantageous to release from the downhole tool when its weight is otherwise supported downhole. Setting down weight moves ramp 48 away from ramp 46 to allow coming out of bore 10 with a pickup force.

The above description is illustrative of the preferred embodiment and many modifications may be made by those skilled in the art without departing from the invention whose scope is to be determined from the literal and equivalent scope of the claims below.

We claim:

1. A milling assembly extending from a well surface for milling and capture of a downhole tool having a flowpath therethrough, comprising:

a mill having a cutting structure and a mandrel defining a passage therethrough having at least one external opening adjacent said cutting structure to accept cuttings created by said cutting structure and carried in by fluid entering said passage, said cuttings carried by said fluid through said mandrel toward the surface;

a grapple assembly comprising at least one gripping member to selectively engage the downhole tool in said flowpath, said mandrel selectively axially supporting said grapple assembly from below in said flowpath and said external opening located between said cutting structure and said gripping member when said gripping member grips the downhole tool.

2. The assembly of claim 1, wherein:

said passage having at plurality of inlets directly in in a body of said mill body.

3. A milling assembly extending from a well surface for milling and capture of a downhole tool, comprising:

a mill having a cutting structure and a mandrel defining a passage therethrough having at least one external opening adjacent said cutting structure to accept cuttings created by said cutting structure and carried in by fluid entering said passage, said cuttings carried by said fluid through said mandrel toward the surface;

a grapple assembly comprising at least one gripping member to selectively engage the downhole tool, said external opening located between said cutting structure and said gripping member when said gripping member grips the downhole tool;

said grapple assembly further comprises a gripping member movably mounted on a mandrel with said gripping member comprising a ring with extending fingers.

4. The assembly of claim 3, wherein:

said fingers form gaps therebetween.

5. The assembly of claim 4, wherein:

said mandrel comprises torque members selectively insertable in said gaps for tandem rotation of said mandrel and said fingers.

6. The assembly of claim 5, wherein:

said torque members have a length inserted into said gaps that is at least as long as said fingers.

7. The assembly of claim 6, wherein:

said fingers have a first axial slope and said mandrel has a second axial slope for selective contact for tandem rotation of said mandrel and said fingers.

8. The assembly of claim 7, wherein:

said first and second slopes are substantially the same angle.

9. The assembly of claim 8, wherein:

said first and second slopes are disposed in a plane that is skewed with respect to a tangent to a circle about a longitudinal axis to said mandrel and extending through such plane.

10. A milling assembly for milling and capture of a downhole tool, comprising:

a mill having a passage therethrough to accept cuttings carried in by fluid entering said passage;

a grapple assembly to selectively engage the downhole tool;

said grapple assembly further comprises a gripping member movably mounted on a mandrel with said gripping member comprising a ring with extending fingers;

said fingers form gaps therebetween;

said mandrel comprises torque members selectively insertable in said gaps for tandem rotation of said mandrel and said fingers;

said torque members have a length inserted into said gaps that is at least as long as said fingers;

said fingers have a first axial slope and said mandrel has a second axial slope for selective contact for tandem rotation of said mandrel and said fingers;

said first and second slopes are substantially the same angle;

said first and second slopes are disposed in a plane that is skewed with respect to a tangent to a circle about a longitudinal axis to said mandrel and extending through such plane;

said fingers have wickers in the shape of a left hand thread so that upon tandem rotation of said mandrel and said fingers the grapple assembly releases from said passage in the downhole tool.

11. A milling assembly for a downhole tool, comprising:

a mill;

a grapple assembly supported by said mill and insertable into a flowpath extending through the downhole tool to grip a wall defining said flowpath against release downhole due to milling, said grapple assembly comprising a torsional support for a gripping member positioned in a first position axially spaced from said gripping member and a second position supporting said gripping member axially from below and against applied torque;

said gripping member comprising circumferentially spaced gripping elements and said torsional support in said second position insertable between said spaced gripping elements.

12. A milling assembly for a downhole tool, comprising:

a mill;

a grapple assembly supported by said mill and insertable into the downhole tool to grip it against release downhole due to milling, said grapple assembly comprising a torsional support for a gripping member positioned in a first position spaced from said gripping member and a second position supporting said gripping member;

said gripping member comprising circumferentially spaced gripping elements and said torsional support in said second position insertable between said spaced gripping elements;

said torsional support is at least as long as said gripping member.

13. The assembly of claim 12, wherein:

said torsional support is movable to a location adjacent said gripping member.

14. The assembly of claim 13, wherein:

said gripping member comprises a ring with extending fingers and said torsional support comprises elongated elements that are selectively disposed between said fingers.

15. The assembly of claim 14, further comprising:

a bearing between said ring of said gripping member and said mill to allow said mill to rotate while said fingers are stationary and engaged to the downhole tool.

16. A milling assembly for a downhole tool, comprising:

a mill;

a grapple assembly supported by said mill and insertable into the downhole tool to grip it against release downhole due to milling, said grapple assembly comprising a torsional support for a gripping member positioned in a first position spaced from said gripping member and a second position supporting said gripping member;

said torsional support is at least as long as said gripping member;

said torsional support is movable to a location adjacent said gripping member;

said gripping member comprises a ring with extending fingers and said torsional support comprises elongated elements that are selectively disposed between said fingers;

said fingers have external wickers in the form of a left hand thread among them that face the downhole tool for selective grip and release therefrom.

17. The assembly of claim 16, wherein:

said fingers have a first ramp surface and said grapple assembly comprises a second ramp surface on a mandrel supported by said mill to mate with said first ramp surface;

said elongated elements are disposed on said mandrel and extend over said second ramp surface.

18. The assembly of claim 17, wherein:

each of said fingers is bounded on opposed sides by an elongated member longer than said left hand thread formed by said wickers when said first and second ramp surfaces overlap.

19. The assembly of claim 18, wherein:

said ramp surfaces overlap in a plane that is skewed with respect to a tangent to a circle about an axis of said mandrel that passes through said plane.

20. The assembly of claim 17, wherein:

said second ramp surface movable away from said first ramp surface with the downhole tool supported with set down weight to selectively release said fingers from said tool.

21. A milling assembly extending from a well surface for milling and capture of a downhole tool, comprising:

a mill having a cutting structure and a mandrel defining a passage therethrough having at least one external opening adjacent said cutting structure to accept cuttings created by said cutting structure and carried in by fluid entering said passage, said cuttings carried by said fluid through said mandrel toward the surface;

a grapple assembly comprising at least one gripping member to selectively engage the downhole tool, said external opening located between said cutting structure and said gripping member when said gripping member grips the downhole tool;

said gripping member is mounted on a mandrel supported by said mill and is axially movable with respect to said mandrel.

22. The assembly of claim 21, wherein:

said fingers have a first ramp surface and said mandrel comprises a mating second ramp surface selectively engaging said first ramp surface;

said ramp surfaces overlap in a plane that is skewed with respect to a tangent to a circle about an axis of said mandrel that passes through said plane.

23. A milling assembly extending from a well surface for milling and capture of a downhole tool, comprising:

a mill having a cutting structure and a mandrel defining a passage therethrough having at least one external opening adjacent said cutting structure to accept cuttings created by said cutting structure and carried in by fluid entering said passage, said cuttings carried by said fluid through said mandrel toward the surface;

a grapple assembly comprising at least one gripping member to selectively engage the downhole tool, said external opening located between said cutting structure and said gripping member when said gripping member grips the downhole tool;

said grapple assembly comprising a grapple mandrel secured to said mandrel on said mill and said at least one opening is located on said grapple assembly mandrel.

* * * * *